US006719592B2

(12) United States Patent
Friedow et al.

(10) Patent No.: US 6,719,592 B2
(45) Date of Patent: Apr. 13, 2004

(54) CONTACT ELEMENT FOR AXIAL CONTACTING

(75) Inventors: Michael Friedow, Grossbottwar (DE); Dietmar Rischen, Vaihingen/enz (DE)

(73) Assignee: Robert Bosch GmbH, Stuttgart (DE)

( * ) Notice: Subject to any disclaimer, the term of this patent is extended or adjusted under 35 U.S.C. 154(b) by 8 days.

(21) Appl. No.: 09/466,400

(22) Filed: Dec. 17, 1999

(65) Prior Publication Data

US 2001/0034160 A1 Oct. 25, 2001

(30) Foreign Application Priority Data

Dec. 18, 1998 (DE) ..... 298 22 588 U

(51) Int. Cl.[7] ..... H01R 24/00
(52) U.S. Cl. ..... 439/675; 439/582
(58) Field of Search ..... 439/675, 582, 439/578, 581, 63, 20, 23

(56) References Cited

U.S. PATENT DOCUMENTS

| | | | | |
|---|---|---|---|---|
| 5,569,049 A | * | 10/1996 | Tatebe et al. | 439/394 |
| 5,759,069 A | * | 6/1998 | Kitatani et al. | 439/675 |
| 5,772,470 A | * | 6/1998 | Togashi | 439/582 |
| 5,971,810 A | * | 10/1999 | Taylor | 439/675 |
| 6,036,540 A | * | 3/2000 | Beloritsky | 439/582 |

* cited by examiner

*Primary Examiner*—Tho D. Ta
*Assistant Examiner*—Edwin A. León
(74) *Attorney, Agent, or Firm*—Kenyon & Kenyon

(57) ABSTRACT

A device for contacting an electrically operated apparatus, having at least one terminal contact on the apparatus and one plug that can be connected to it axially, with the plug including a sleeve contact which is in contact with an electrically conducting contact area of the terminal contact after joining them, with the terminal contact being oriented parallel to an installation direction of the apparatus, and the sleeve contact being connectable to the terminal contact parallel to the installation direction.

24 Claims, 1 Drawing Sheet

CONTACT ELEMENT FOR AXIAL CONTACTING

FIELD OF THE INVENTION

The present invention relates to a device for contacting an electrically operated apparatus having at least one terminal contact on the apparatus and one plug that can be connected to it axially, with the plug including a sleeve contact.

BACKGROUND INFORMATION

Electrically operated apparatuses, e.g., hydraulic actuators such as solenoid valves and pressure regulators, must frequently be installed with a directional orientation in further processing, so that the electric contacts are located in a defined position. This is necessary, for example, when an arrangement of actuators is to be contacted jointly and electrically in one operation. For example, if the terminal contacts of the actuator are arranged laterally to its longitudinal axis, the position of the actuator must usually be changed, so that the terminal contacts can be connected to a suitable plug. The respective precise orientation of the actuators is an additional operation that is to be avoided. In addition, lateral contacting of the actuator leads to the result that tolerances in its longitudinal direction can hardly be compensated because, with radial contacting, displacement in the direction of the longitudinal axis is possible only to a limited extent because the contact area of the internal contact is usually limited. In radial contacting, the direction of joining of the actuator and of the plug contact are not identical, so two assembly directions are necessary when assembling the actuator on a carrier and when assembling the plug on the apparatus, so the assembly operation must necessarily be sequential.

SUMMARY OF THE INVENTION

Therefore, an object of the present invention is to provide a device for contacting an electrically operated apparatus, so that the contacting can be accomplished with less orientation complexity, and tolerances in the longitudinal direction of the apparatus can be compensated easily. On the other hand, another object of the present invention is to permit simultaneous assembly of the apparatus and the plug.

According to the present invention, the terminal contact is oriented parallel to an installation direction of the apparatus, and the sleeve contact can be connected to the terminal contact parallel to the installation direction.

It has been found according to the present invention that assembly of one or more apparatuses on a carrier and connecting the respective plugs to the apparatuses can be accomplished simultaneously by axial contacting. If the plugging direction of the plugs corresponds to the installation direction of the apparatuses, only a precise radial orientation of the plugs is necessary, and thus axial compensation of tolerance is possible in the installation direction of the apparatuses due to the fact that the plugs need not be pushed onto the terminal contacts as far as the stop. Then contacting with a punched grid, for example, can take place simultaneously with assembly of an actuator. At the manufacturing plant, one direction of assembly may be eliminated through the axial assembly of the plugs, thereby reducing the expense in terms of workpiece carriers and devices.

In an especially advantageous embodiment of the present invention, the plug has two sleeve contacts, arranged concentrically in particular, which can be connected to two concentric terminal contacts of the apparatus. The electrically operated apparatus has two terminal contacts, preferably in a concentric arrangement, on the rear side, i.e., the side opposite the installation direction. The terminal contacts may be provided, for example, by two bushings arranged concentrically one inside the other. However, the contact on the inside may also be designed as a solid cylindrical contact, e.g., as a contact pin. Then the sleeve contacts of the plug are arranged concentrically one inside the other and fit together with the terminal contacts. The inside diameter of the sleeve contacts at the end is preferably such that they can be connected conveniently; for example, the front ends of the sleeves may be adapted to one another or may diverge conically.

The sleeve contacts are preferably each in contact with the concentric terminal contacts on the outside circumference when joined together. This results in an especially large contact area between the terminal contacts of the apparatus and the sleeve contacts.

In an especially advantageous embodiment of the present invention, the terminal contacts are two contact faces bent into a cylindrical shape in particular and provided on the end of an apparatus casing. These contact faces have different diameters and are arranged accordingly, so that an insulation bushing can optionally be inserted between the coaxial terminal contacts, and the two sleeve contacts of the plug can be inserted without causing a short circuit between the sleeve contacts and the terminal contacts.

Insulation is preferably arranged between the terminal contacts. The insulation is made of plastic and in one case it is an insulation sleeve. However, the insulation may also be applied as a nonconducting layer directly to the terminal contacts or the sleeve contacts. Different insulation materials may also be used with regard to a contacting force, in order to make it difficult to pull the contacts apart, for example.

In another preferred embodiment, in the assembled state the back wall of the plug also forms an insulation which acts together with the insulation between the terminal contact to form two contact chambers insulated from one another. This yields protection against metal chips at the contact point in an especially advantageous manner. The two poles of the contact are completely covered with respect to one another by the back plastic wall of the plug. No short circuit can develop due to a long sliver. In addition, insulation on the outside may also completely cover the contact in the manner of a casing. The internal terminal contact with the adjacent internal sleeve contact is then separated by the insulation sleeve from the outer terminal contact with the adjacent outer sleeve contact. However, the outer end of the insulation sleeve is also in contact with the insulated back wall of the plug, so that the internal terminal contact is encapsulated. Only the connecting conductor leads radially out of the insulated area.

The printed conductor of the interior sleeve contact is preferably passed through a recess in the exterior sleeve contact. The sleeve contacts may be designed as cylindrical segments. A section of the essentially cylindrical segment remains free, with the printed conductor of the internal sleeve contact passing through this section and the sleeve contact on the outside.

Instead of a cylindrical or segmented cylindrical cross section, the sleeve contact may also have a polygonal cross section. The advantage of this cross section is that the plug can then no longer be rotated about its longitudinal axis or the installation direction with respect to the terminal contacts. This rotating may of course also be prevented in a traditional manner by a small lug which engages in a groove.

The sleeve contacts preferably have a diameter that allows a defined contacting force. The sleeve contacts may have inclined insertion guides to permit easy positioning of the terminal contacts.

The plugs are preferably connected to punched grid conductors. The sleeve contact and the corresponding punched grid conductor may be designed in one piece. The end of the punched grid conductor is designed to be somewhat wider than the punched grid conductor, and it may be bent to form the segmented cylindrical sleeve contact by bending or folding. This eliminates the need for an additional solder connection to connect the plug to the punched grid conductor.

DETAILED DESCRIPTION

Figure 1:
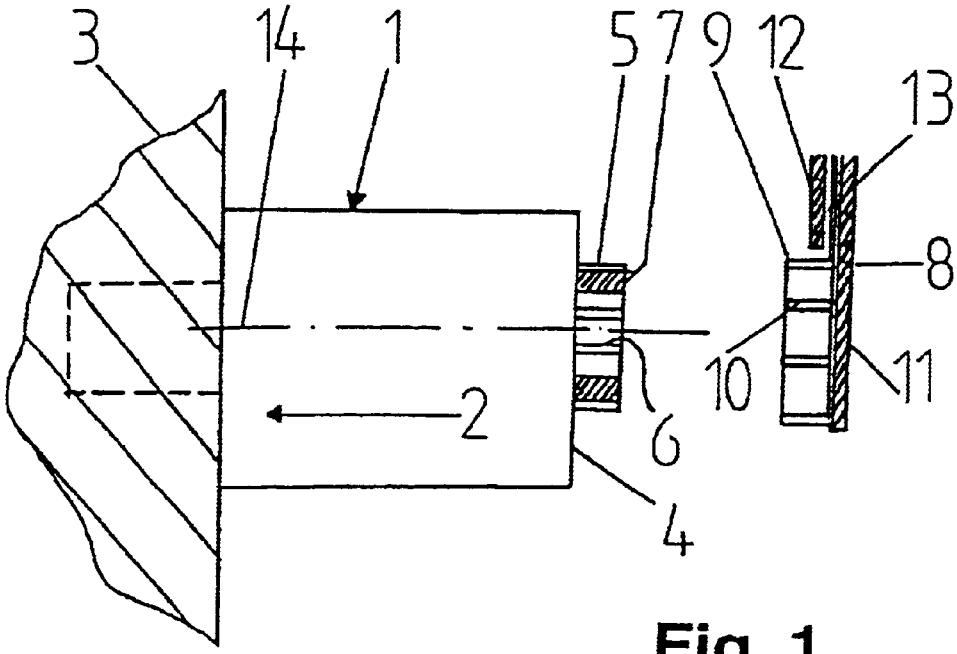
FIG. 1 shows a side view of an actuator with concentrically arranged terminal contacts and a plug with sleeve contacts fitting it.

Actuator 1 is installed in a machine 3 in an installation direction 2. A device for contacting the electrically operated actuator with a terminal contact 5 on the apparatus, a second terminal contact 6 on the apparatus and an insulation sleeve 7 arranged between them is provided at the end, i.e., on one end side 4 of elongated actuator 1 opposite the installation direction. Terminal contact 5 has a larger diameter than terminal contact 6, i.e., terminal contact 5 is arranged to lie on the outside.

A plug 8 is equipped with sleeve contacts 9 and 10 fitting terminal contacts 5 and 6. Plug 8 has an insulating back wall 11 and additional insulation means 12 to prevent a short circuit between a punched grid conductor 13 connected to plug 8 with exposed metal objects. Terminal contacts 5, 6 as well as sleeve contacts 9, 10 are arranged concentrically about a longitudinal axis 14 running through actuator 1.

During assembly, actuator 1 is mounted on machine 3 in the installation direction, and plug 8 with sleeve contacts 9 and 10 is placed on terminal contacts 5 and 6 either subsequently or simultaneously and is connected to them.

Figure 2:
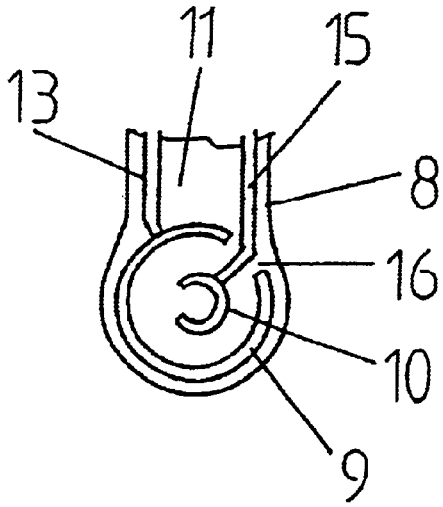
FIG. 2 shows a top view of the plug with two sleeve contacts according to the present invention.

As shown best in FIG. 2, sleeve contacts 9 and 10 are designed only as segmented cylinders. Consequently, punched grid conductor 15 of interior sleeve contact 10 can be passed through recess 16 in exterior sleeve contact 9 without resulting in a short circuit.

When terminal contacts 5, 6 and sleeve contacts 9, 10 are joined, insulation sleeve 7 with insulating back wall 11 of the plug forms a contact chamber around interior sleeve contact 10 and interior terminal contact 6. This makes it possible to avoid short circuits produced by machining residues from production.

What is claimed is:

1. A device for contacting an electrically operated apparatus, comprising:

at least one terminal contact on a side of the apparatus, the at least one terminal contact being oriented parallel to an installation direction of the apparatus; and a plug for connecting axially to the at least one terminal contact, the plug including at least one sleeve contact, the at least one sleeve contact and the at least one terminal contact being adapted to be assembled together parallel to the installation direction, wherein the at least one sleeve contact includes two concentric sleeve contacts and the at least one terminal contact includes two concentric terminal contacts, the two concentric sleeve contacts connecting to the two concentric terminal contacts, wherein the terminal contacts have two contact plates bent into a cylindrical shape and situated on an end of a casing of the apparatus.

2. The device according to claim 1, wherein the at least one sleeve contact has a diameter so as to overcome a predetermined contacting force when connected.

3. The device according to claim 1, further comprising:

a plurality of punched grid conductors connected to the plug.

4. The device according to claim 1, further comprising:

an insulation situated between the terminal contacts.

5. The device according to claim 4, wherein the insulation includes an insulating sleeve composed of a plastic.

6. The device according to claim 4, wherein in an assembled state, a back wall of the plug acts as a further insulation which, together with the insulation between the terminal contacts, form two contact chambers insulated from one another.

7. A device for contacting an electrically operated apparatus, comprising:

at least one terminal contact on a side of the apparatus, the at least one terminal contact being oriented parallel to an installation direction of the apparatus; and a plug for connecting axially to the at least one terminal contact, the plug including at least one sleeve contact, the at least one sleeve contact and the at least one terminal contact being adapted to be assembled together parallel to the installation direction, wherein the at least one sleeve contact includes two concentric sleeve contacts and the at least one terminal contact includes two concentric terminal contacts, the two concentric sleeve contacts connecting to the two concentric terminal contacts, wherein the at least one sleeve contact includes an interior sleeve contact and an exterior sleeve contact, a printed conductor of the interior sleeve contact passing through a recess in the exterior sleeve contact.

8. The device according to claim 7, wherein the at least one sleeve contact has a diameter so as to overcome a predetermined contacting force when connected.

9. The device according to claim 7, further comprising:

a plurality of punched grid conductors connected to the plug.

10. The device according to claim 7, further comprising:

an insulation situated between the terminal contacts.

11. The device according to claim 10, wherein the insulation includes an insulating sleeve composed of a plastic.

12. The device according to claim 10, wherein in an assembled state, a back wall of the plug acts as a further insulation which, together with the insulation between the terminal contacts, form two contact chambers insulated from one another.

13. A device for contacting an electrically operated apparatus, comprising:

at least one terminal contact on a side of the apparatus, the at least one terminal contact being oriented parallel to an installation direction of the apparatus; and a plug for connecting axially to the at least one terminal contact, the plug including at least one sleeve contact, the at least one sleeve contact and the at least one terminal contact being adapted to be assembled together parallel to the installation direction, wherein the at least one sleeve contact includes two concentric sleeve contacts and the at least one terminal contact includes two concentric terminal contacts, the two concentric sleeve contacts connecting to the two concentric terminal contacts, wherein the electrically operated apparatus includes an actuator.

14. The device according to claim 13, wherein the at least one sleeve contact has a diameter so as to overcome a predetermined contacting force when connected.

15. The device according to claim 13, further comprising:

a plurality of punched grid conductors connected to the plug.

16. The device according to claim 13, further comprising:

an insulation situated between the terminal contacts.

17. The device according to claim 16, wherein the insulation includes an insulating sleeve composed of a plastic.

18. The device according to claim 16, wherein in an assembled state, a back wall of the plug acts as a further insulation which, together with the insulation between the terminal contacts, form two contact chambers insulated from one another.

19. A device for contacting an electrically operated apparatus, comprising:

at least one terminal contact on a side of the apparatus, the at least one terminal contact being oriented parallel to an installation direction of the apparatus; and a plug for connecting axially to the at least one terminal contact, the plug including at least one sleeve contact, the at least one sleeve contact and the at least one terminal contact being adapted to be assembled together parallel to the installation direction, wherein the at least one sleeve contact includes two concentric sleeve contacts and the at least one terminal contact includes two concentric terminal contacts, the two concentric sleeve contacts connecting to the two concentric terminal contacts, wherein the electrically operated apparatus includes at least one of an actuator, a hydraulic actuator, a solenoid valve and a pressure regulator.

20. The device according to claim 19, wherein the at least one sleeve contact has a diameter so as to overcome a predetermined contacting force when connected.

21. The device according to claim 19, further comprising:

a plurality of punched grid conductors connected to the plug.

22. The device according to claim 19, further comprising:

an insulation situated between the terminal contacts.

23. The device according to claim 22, wherein the insulation includes an insulating sleeve composed of a plastic.

24. The device according to claim 22, wherein in an assembled state, a back wall of the plug acts as a further insulation which, together with the insulation between the terminal contacts, form two contact chambers insulated from one another.

* * * * *